US007679296B2

(12) United States Patent
Kamatani

(10) Patent No.: US 7,679,296 B2
(45) Date of Patent: Mar. 16, 2010

(54) LIGHT EMITTING DIODE DRIVE CIRCUIT

(75) Inventor: Tomohiko Kamatani, Kawanishi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/117,237

(22) Filed: May 8, 2008

(65) Prior Publication Data

US 2008/0278098 A1 Nov. 13, 2008

(30) Foreign Application Priority Data

May 11, 2007 (JP) ..... 2007-126612

(51) Int. Cl.
*H05B 37/02* (2006.01)

(52) U.S. Cl. ..... 315/308; 315/209 R; 315/294

(58) Field of Classification Search ..... 315/209 R, 315/210, 246–247, 250, 291, 294, 307–308, 315/312, 324
See application file for complete search history.

(56) References Cited

U.S. PATENT DOCUMENTS 7,423,389 B2 * 9/2008 Lee ..... 315/308
2007/0114951 A1 * 5/2007 Tsen et al. ..... 315/291
2007/0257645 A1 * 11/2007 Nishino ..... 323/276
2007/0296353 A1 * 12/2007 Ito et al. ..... 315/307
2008/0100232 A1 * 5/2008 Miguchi ..... 315/294
2009/0134817 A1 * 5/2009 Jurngwirth et al. ..... 315/307

FOREIGN PATENT DOCUMENTS

JP 11-42809 2/1999

* cited by examiner

*Primary Examiner*—David Hung Vu
*Assistant Examiner*—Tung X Le
(74) *Attorney, Agent, or Firm*—Dickstein Shapiro LLP

(57) ABSTRACT

A drive circuit includes a constant voltage circuit to supply a constant voltage to one terminal of a load, a constant current circuit to supply a predetermined constant current to another terminal of the load in accordance with a pulse signal input externally, and a first reference voltage generator to generate and output a first reference voltage in accordance with an output voltage at an output terminal of the constant current circuit. The constant voltage circuit controls so that the first reference voltage is proportional to the output voltage output to the load.

16 Claims, 4 Drawing Sheets

LIGHT EMITTING DIODE DRIVE CIRCUIT

CROSS-REFERENCE TO RELATED APPLICATION

This patent application claims priority to Japanese Patent Application No. 2007-126612, filed on May 11, 2007 in the Japan Patent Office, the entire contents of which are incorporated by reference herein.

FIELD

This patent specification relates to a drive circuit, and more particularly, to a light emitting diode drive circuit.

BACKGROUND

Recently, light emitting diodes (LEDs) have come to be widely used in a variety of types of electrical equipment, for example, display devices, optical disk apparatuses, and the like, because of their low power requirements and long life. The light emitting diode emits light by supplying an electrical current to the light emitting diode by a LED drive circuit.

The LED drive circuit generally employs a so-called LED-terminal-voltage-comparison method because it is possible to reduce total power consumption of the LED drive circuit in light of fluctuations in forward voltage of the LED caused by inconsistencies in the manufacturing process. In the LED-terminal-voltage-comparison method, a switching regulator that forms a constant voltage circuit to supply power to the LED is controlled in accordance with results of a comparison made between a voltage that is a terminal voltage between LED terminals and a reference voltage.

However, when lighting the LED is controlled in accordance with a pulse signal modulated by pulse width modulation (PWM) using this drive circuit, it is not possible to control the terminal voltage of the LED stably, especially when the LED is on. Therefore, the only alternative is to employ a so-called output-voltage-comparison method, in which an output voltage of the switching regulator is controlled in accordance with a voltage comparison result of a divided voltage obtained by dividing the output voltage of the switching regulator with respect to a predetermined reference voltage.

FIG. 1 is a schematic diagram of a circuit configuration of a known LED drive circuit. In FIG. 1, the LED drive circuit 100 includes a constant voltage circuit 101, a constant current circuit 102, and a reference voltage generator 103. The constant voltage circuit 101 outputs a predetermined constant voltage to a LED 110. The constant current circuit 102 supplies a constant current to the LED 110. The constant voltage circuit 101 forms a switching regulator and controls a switching transistor (not shown) to supply a predetermined constant voltage to the LED 110, so that a divided voltage obtained by dividing an output voltage of the constant voltage circuit 101 becomes a predetermined reference voltage $V_{ref}$ output from the reference voltage generator 103. A pulse signal Spwm is input to the constant current circuit 102 externally, and the constant current circuit 102 supplies a constant current to the LED 110 in accordance with the pulse signal Spwm.

However, in the LED drive circuit 100, the reference voltage must be determined in consideration of fluctuations in forward voltage of the LED caused by inconsistencies in the manufacturing process. Accordingly, the total power consumption of the LED drive circuit increases compared to the LED-terminal-voltage-comparison method previously described.

A typical forward voltage value of a white LED used for a display of a portable device is 3.2 volts (TYP), a minimum voltage value (MIN) is 3.0 volts, and a maximum voltage value (MAX) is 3.9 volts. Therefore, in the output-voltage-comparison method, the reference voltage $V_{ref}$ must be determined in consideration of the MAX voltage value, 3.9 volts which is the maximum voltage value of the forward voltage of the white LED due to the variation caused during the manufacturing process. Since the typical voltage value of the forward voltage of the white LED is 3.2 volts, the drive circuit needs to output a voltage for most of the LED devices that is higher by 0.7 volts than an output voltage for the typical LED device. When a higher output voltage is output, the power consumption of the total drive circuit increases. Further, large power consumption may cause a heat problem when the drive circuit is formed in a semiconductor integrated circuit.

SUMMARY

This patent specification describes a novel drive circuit that includes a constant voltage circuit to supply a constant voltage to one terminal of a load, a constant current circuit to supply a predetermined constant current to another terminal of the load in accordance with a pulse signal input externally, and a first reference voltage generator to generate and output a first reference voltage in accordance with an output voltage at an output terminal of the constant current circuit. The constant voltage circuit operates so that the first reference voltage is proportional to the output voltage output to the load.

This patent specification further describes a novel electrical device that drives more than one light emitting device comprising a drive circuit. The drive circuit includes a constant voltage circuit to supply a constant voltage to one terminal of a load, a constant current circuit to supply a predetermined constant current to another terminal of the load in accordance with a pulse signal input externally, and a first reference voltage generator to generate and output a first reference voltage in accordance with an output voltage at an output terminal of the constant current circuit. The constant voltage circuit operates so that the first reference voltage is proportional to the output voltage output to the load.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
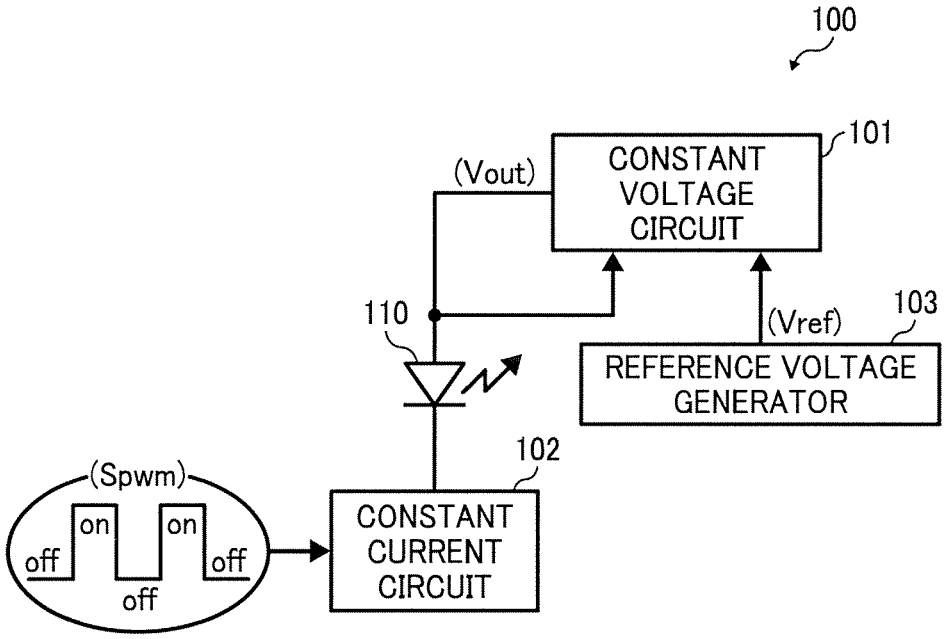
FIG. 1 PRIOR ART
FIG. 1 illustrates a schematic of a circuit configuration of a known LED drive circuit.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, wherein like reference numerals designate identical or corresponding parts throughout the several views, switching regulators according to example embodiments are described.

Figure 2:
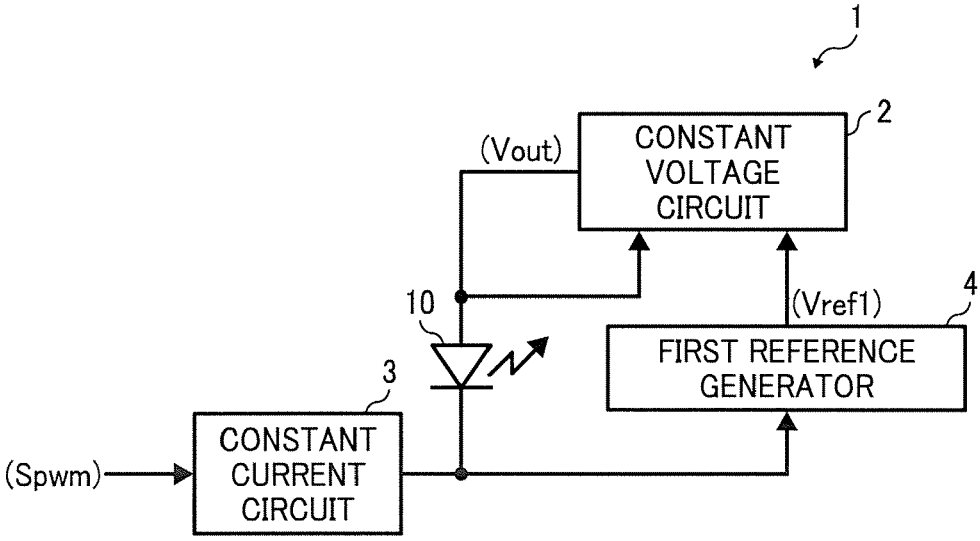
FIG. 2 illustrates a block diagram of a LED drive circuit according to a first example embodiment of the present disclosure.

FIG. 2 is a block diagram of a drive circuit according to a first example embodiment of the present disclosure. The drive circuit 1 is mounted on an electronic device such as a mobile phone, and causes a LED 10 to emit light in accordance with a pulse signal Spwm modulated by PWM modulation. In some cases, the drive circuit 1 is mounted on the electronic device with the LED 10.

The drive circuit 1 includes a constant voltage circuit 2, a constant current circuit 3, and a first reference voltage generator 4. The constant voltage circuit 2 outputs an output voltage Vout, and supplies power to an anode of the LED 10. The constant voltage circuit 2 forms a switching regulator. The constant current circuit 3 supplies a current to the LED 10 in accordance with a pulse signal Spwm input externally. The first reference voltage generator 4 generates a first reference voltage $V_{ref1}$ in accordance with a voltage at a connection node of the constant current circuit 3 and a cathode of the LED 10, and outputs the first reference voltage $V_{ref1}$ to the constant voltage circuit 2. The constant voltage circuit 2 forms a constant voltage circuit unit, the constant current circuit 3 forms a constant current circuit unit, the first reference voltage generator 4 forms a first reference voltage generation circuit unit, and the LED 10 forms a load.

The constant voltage circuit 2 operates so that a divided voltage Vfb generated by dividing the output voltage Vout and output to the anode of the LED 10 becomes the first reference voltage $V_{ref1}$. The constant current circuit 3 supplies a constant current to the LED 10 when the pulse signal Spwm becomes a predetermined signal level, for example, a high level, and stops supplying the constant current when the pulse signal Spwm becomes a low level.

The first reference voltage generator 4 increases the first reference voltage $V_{ref1}$ when a voltage at a connection node between the constant current circuit 3 and the cathode of the LED 10 is equal to or less than a predetermined second reference voltage $V_{ref2}$. Further, the first reference voltage generator 4 decreases the first reference voltage $V_{ref1}$ when the voltage at the connection node between the constant current circuit 3 and the cathode of the LED 10 is equal to or more than a predetermined third reference voltage $V_{ref3}$. Furthermore, the first reference voltage generator 4 holds and outputs a present value of the first reference voltage $V_{ref1}$ when the voltage at the connection node between the constant current circuit 3 and the cathode of the LED 10 is more than the second reference voltage $V_{ref2}$ but less than the third reference voltage $V_{ref3}$.

Figure 3:
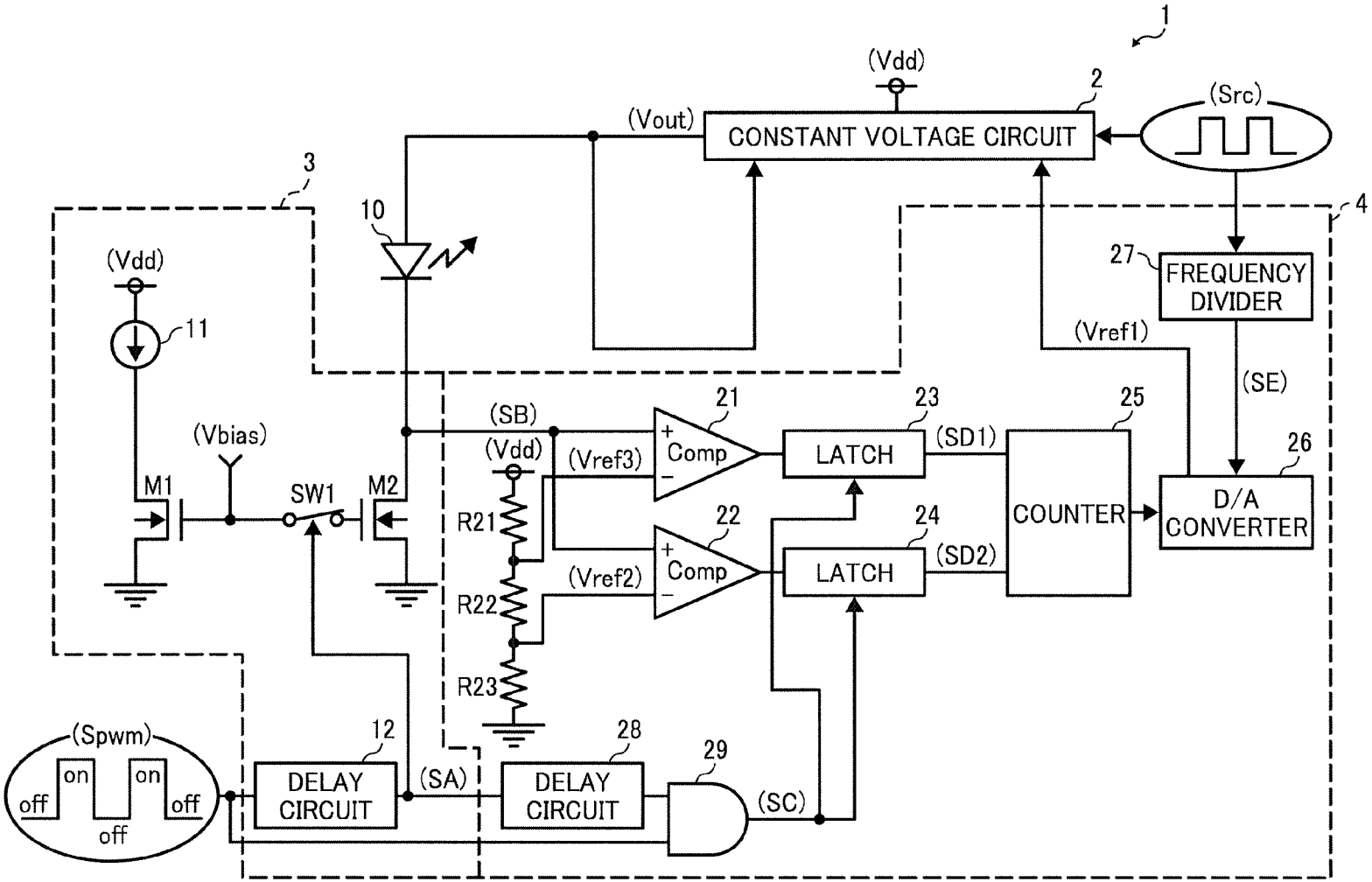
FIG. 3 illustrates example circuits of a constant current circuit and a first reference voltage generator of FIG. 2.

FIG. 3 illustrates an example circuit of the constant current circuit 3 and the first reference voltage generator 4. The constant current circuit 3 includes NMOS transistors M1 and M2, a switch SW1, a constant current source 11, and a delay circuit 12. The first reference voltage generator 4 includes comparators 21 and 22, latch circuits 23 and 24, a counter 25, a D/A (digital to analog) converter 26, a frequency divider 27, a delay circuit 28, an AND circuit 29, and resistors R21, R22 and R23. The comparators 21 and 22 form a voltage comparison circuit unit. The latch circuits 23 and 24, the counter 25, and the D/A converter 26 form a D/A convert circuit unit. The resistors R21, R22 and R23 form a second and third reference voltage generation circuit units.

In the constant current circuit 3, between a power supply terminal at which power supply voltage Vdd is applied and ground, the constant current source 11 and the NMOS transistor M1 are connected in series. A current with a predetermined value is supplied to a drain of the NMOS transistor M1 from the constant current source 11. A bias voltage $V_{bias}$ with a predetermined value is input to a gate of the NMOS transistor M1 externally, and is input to a gate of the NMOS transistor M2 through the switch SW1. The NMOS transistor M2 is connected between a cathode of the LED 10 and ground. A drain of the NMOS transistor M2 forms an output terminal of the constant current circuit 3. The delay circuit 12 delays the pulse signal Spwm by a predetermined first delay time T1, and outputs a delayed pulse signal as a pulse signal SA. The switch SW1 switches in accordance with the pulse signal SA.

In the first reference voltage generator 4, between the power supply terminal and ground, the resistors R21, R22 and R23 are connected in series. A voltage at a connection node of the resistors R21 and R22 is a third reference voltage $V_{ref3}$ and is input to an inverted input terminal of the comparator 21. A voltage at a connection node of the resistors R22 and R23 is a second reference voltage $V_{ref2}$ and is input to an inverted input terminal of the comparator 22. A signal SB which is the voltage at the connection node of the cathode of the LED 10 and the drain of the NMOS transistor M2 is input to each non-inverted input terminal of the comparators 21 and 22. Each output signal of the comparators 21 and 22 is input to corresponding latch circuits 23 and 24, respectively.

The pulse signal SA is delayed by a predetermined second delay time T2 by the delay circuit 28 and is output to one input terminal of the AND circuit 29. The pulse signal Spwm is input to another input terminal of the AND circuit 29. An output signal SC of the AND circuit 29 is input to the latch circuits 23 and 24. The latch circuits 23 and 24 perform latch operation in accordance with the signal SC, respectively. Each output signal SD1 and SD2 of the latch circuits 23 and 24 is input to the counter 25, respectively. A digital signal indicating a count number of the counter 25 is output to the D/A converter 26. The frequency divider 27 divides a reference clock signal Src input externally, and outputs a divided clock signal to the D/A converter 26 as a clock signal SE. The D/A converter 26 performs a digital-to-analog conversion by sampling the signal input from the counter 25 in synchronization with the clock signal SE, and outputs a converted signal to the constant voltage circuit 2 as the first reference voltage $V_{ref1}$.

Figure 4:
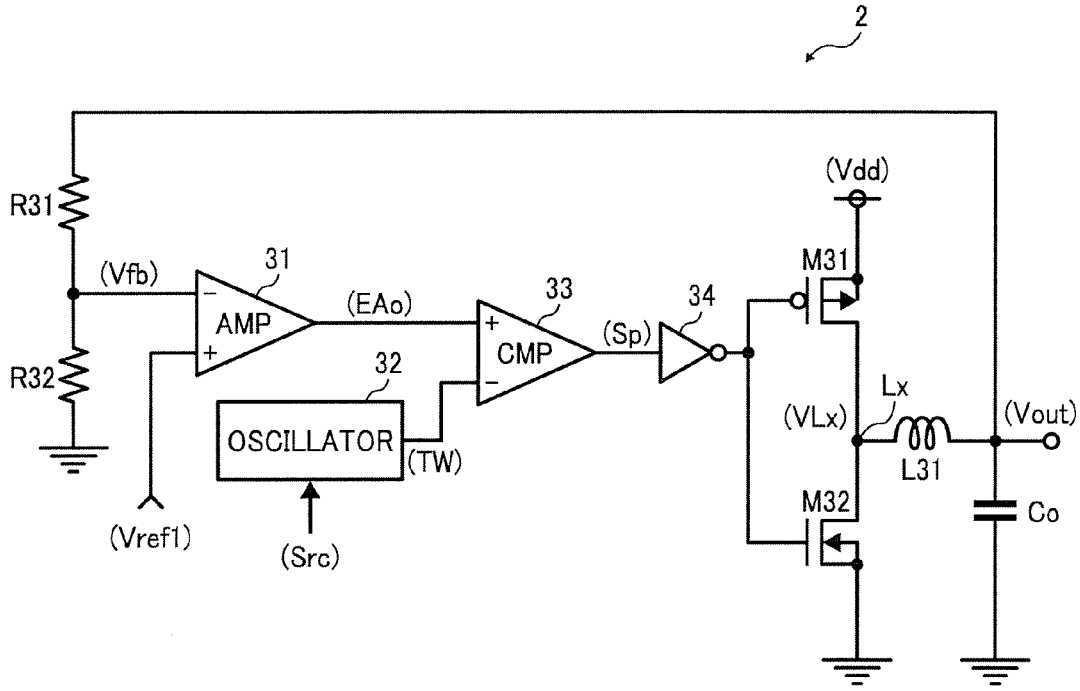
FIG. 4 illustrates an example circuit of the constant voltage circuit of FIGS. 2 and 3.

FIG. 4 illustrates an example circuit of the constant voltage circuit 2 of FIGS. 2 and 3. In FIG. 4, a step-down type switching regulator is shown as an example.

In FIG. 4, the constant voltage circuit 2 converts power supply voltage Vdd input as an input voltage to a predetermined constant voltage, and outputs a converted voltage to the anode of the LED 10 so as to function as a synchronous rectification switching regulator. The constant voltage circuit 2 includes a switching transistor M31, a synchronous transistor M32, resistors R31 and R32, an inductor L31, an output capacitor Co, an error amplifier 31, an oscillator 32, a PWM comparator 33, and an inverter 34. The switching transistor M31 is formed of PMOS transistor, and is configured to switch for controlling the output voltage from the power voltage Vdd. The switching transistor M32 is formed of an NMOS transistor. The resistors R31 and R32 detect the output voltage, and the output condenser Co is used for smoothing.

The resistors R31 and R32 for detection of the output voltage divide the output voltage Vout, and generate and output a divided voltage Vfb. Further, the error amplifier 31 amplifies a difference between the divided voltage Vfb and the first reference voltage $V_{ref1}$, and generates and outputs a generated output signal EAo. The oscillator 32 generates a triangular wave signal TW from the reference signal Src input externally, and outputs the triangular wave signal TW. The PWM comparator 33 generates a pulse signal Sp by performing a PWM conversion with the output signal EAo based on the triangular wave signal TW and the output signal EAo, and outputs the pulse signal Sp. The pulse signal Sp is inverted by the inverter 34, and is input to each gate of the switching transistor M31 and the synchronous transistor M32. The switching transistor M31 and the synchronous transistor M32 are connected in series between the power supply terminal and ground. A connection node between the switching transistor M31 and the synchronous transistor M32 is designated Lx.

The inductor L31 is connected between the connection node Lx and the output terminal. The capacitor Co is connected between the output terminal and ground, and the resistors R31 and R32 are connected in series. The divided voltage Vfb is output from a connection node between the resistors R31 and R32. The divided voltage Vfb is input to an inverted input terminal of the error amplifier 31, and the first reference voltage $V_{ref1}$ is input to a non-inverted input terminal of the error amplifier 31. The output terminal of the error amplifier 31 is connected to a non-inverted input terminal of the PWM comparator 33. The triangular wave signal TW is input to an inverted input terminal of the PWM comparator 33. The pulse signal Sp output from the PWM comparator 33 is input to each gate of the switching transistor M31 and the synchronous transistor M32 through the inverter 34.

When the output voltage Vout increases, a voltage of the output signal EAo from the error amplifier 31 decreases. Accordingly, an on-duty cycle of the pulse signal Sp from the PWM comparator 33 decreases. Namely, an on-time of the switching transistor M31 becomes short. Meanwhile, an on-time of the synchronous transistor M32 becomes long. As a result, the output voltage Vout is controlled to be decreasing.

When the output voltage Vout decreases, the output signal EAo from the error amplifier 31 increases. Accordingly, the on-duty cycle of the pulse signal Sp from the PWM comparator 33 declines. Namely, the on-time of the switching transistor M31 becomes long. Meanwhile, an on-time of the synchronous transistor M32 decreases. As a result, the output voltage Vout is increased. The above-described operations are repeated so that the output voltage Vout is maintained at a predetermined constant voltage.

Figure 5:
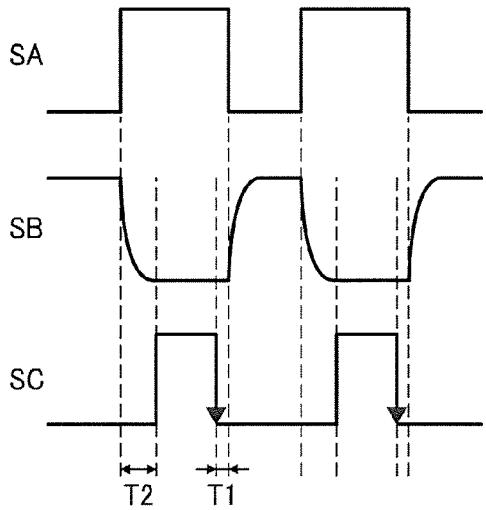
FIG. 5 is a timing chart showing waveforms of pulse signals.

FIG. 5 is a timing chart showing waveforms of the signals SA, SB and SC using circuit configuration described above. Referring to FIG. 5, operations of the constant current circuit 3 and the latch circuits 23 and 24 will be described.

When the pulse signal SA generated by the delay circuit 12 by delaying the pulse signal Spwm becomes a high level, the switch SW1 turns on to create a conduction state. A voltage of the signal SB is dropped to a lower voltage by the forward voltage of the LED 10 from the output voltage Vout. When the pulse signal SA becomes a low level, the switch SW1 turns off to create a shutdown state and the voltage of the signal SB increases.

The AND circuit 29 outputs the pulse signal SC with a low level during a period extending from when the pulse signal Spwm becomes a high level until the output signal of the delay circuit 28 becomes a high level. When the output signal of the delay circuit 28 becomes a high level, the AND circuit 29 outputs the pulse signal SC at a high level.

When the pulse signal Spwm becomes a low level, the AND circuit 29 outputs the pulse signal SC at a low level independently of the output signal of the delay circuit 28. When the pulse signal SC falls to a low level from a high level, the latch circuit 23 and 24 latch the signal levels of the output signal from the corresponding comparators 21 and 22.

The comparator 21 outputs a signal at a high level when a voltage of the signal SB becomes equal to or higher than the third reference voltage $V_{ref3}$. Further, the comparator 21 outputs a signal at a low level when a voltage of the signal SB falls below the third reference voltage $V_{ref3}$. The comparator 22 outputs a signal at a high level when a voltage of the signal SB becomes higher than the second reference voltage $V_{ref2}$. Further, the comparator 21 outputs a signal at a low level when a voltage of the signal SB becomes equal to or less than the second reference voltage $V_{ref2}$.

The counter 25 performs a count-down operation with a count number by decrementing the count number when both output signals SD1 and SD2 from the latch circuits 23 and 24 are high level. Further, the counter 25 performs a count-up operation with the count number by incrementing the count number when both output signals SD1 and SD2 from the latch circuits 23 and 24 are low level. The counter 25 holds the current count number when the output signals SD1 and SD2 from the latch circuits 23 and 24 differ from each other.

The digital signal indicating the count number of the counter 25 is output to the D/A converter 26. The D/A converter 26 performs a sampling operation in synchronization with the clock signal SE input from the frequency divider 27. Then, for example, in synchronization with a rising edge of the clock signal SE from a low level to a high level, the D/A converter 26 performs a digital-to-analog conversion with the digital signal, and generates and outputs the first reference voltage $V_{ref1}$ to the non-inverted terminal of the error amplifier 31 in the constant voltage circuit 2.

Figure 6:
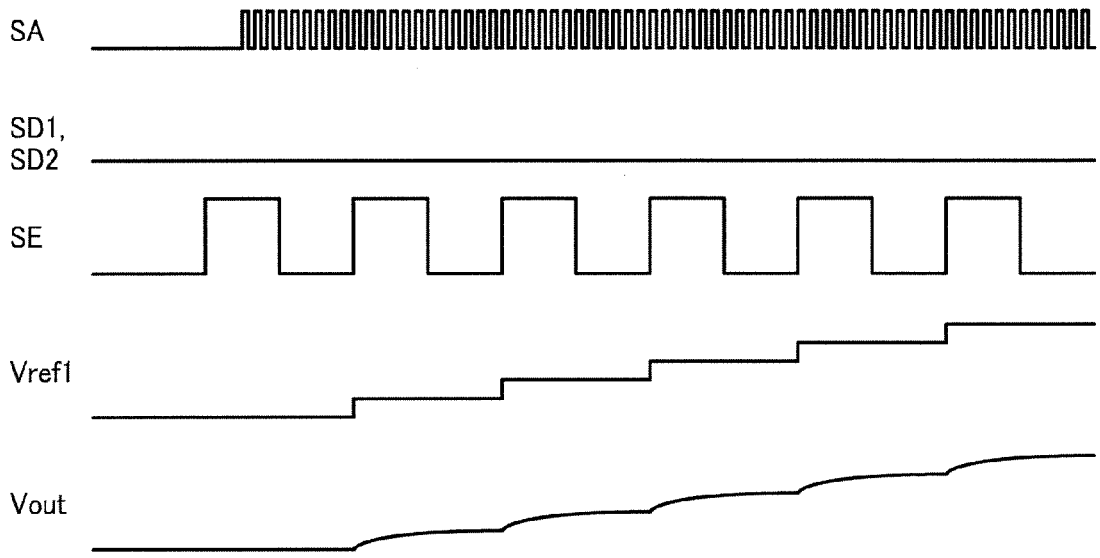
FIG. 6 is a timing chart showing waveforms of the signals shown in FIG. 3 at a start-up.

FIG. 6 is a timing chart showing waveforms of the signals shown in FIG. 3 at a start-up. Referring to FIG. 6, an operation of the first reference generation circuit 4 will be described.

At the start-up at which the supply of power supply voltage Vdd is begun and input of the pulse signal Spwm is begun, each output signal SD1 and SD2 from the latch circuits 23 and 24 are both low level as shown in FIG. 6 so that the counter 25 performs the count-up operation with the count number. Accordingly, the first reference voltage $V_{ref1}$ output from the D/A converter 26 increases in a stepwise fashion in synchronization with the rising edge of the clock signal SE input from the frequency divider 27. As a result, the constant voltage circuit 2 increases the output voltage Vout gradually. That is, as shown in FIG. 6, the constant voltage circuit 2 and the first reference voltage circuit 4 perform a soft-start operation, in which the output voltage Vout increases gradually. Thus, it is possible to perform the soft-start operation without a special soft-start circuit according to the first example embodiment.

Figure 7:
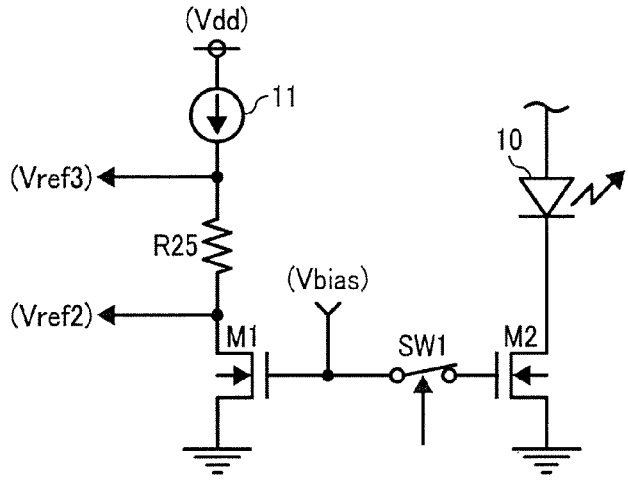
FIG. 7 illustrates another first reference voltage generator.

FIG. 7 illustrates another first reference voltage generator. In FIG. 3, the second reference voltage $V_{ref2}$ and the third reference voltage $V_{ref3}$ are generated by dividing the output voltage Vout using the resistors R21, R22 and R23. However, if a resistor R25 is connected between the constant current source 11 and the NMOS transistor M1 as shown in FIG. 7, the second reference voltage $V_{ref2}$ can be output from a connection node between the resistor R25 and the NMOS transistor M1. Further, the third reference voltage $V_{ref3}$ can be output from a connection node between the constant current source 11 and the resistor R25. In such a circuit configuration, a number of the resistors can be reduced, resulting in cost reduction.

In the drive circuit according to the first example embodiment as described above, the current supplied from the constant current circuit 3 to the LED 10 is controlled in accordance with the pulse signal Spwm. Further, power supply voltage to the LED 10 is supplied from the constant voltage circuit 2. The constant voltage circuit 2 generates and outputs the output voltage Vout to the LED 10 so that the divided voltage Vfb generated by dividing the output voltage Vout becomes equal to the first reference voltage $V_{ref1}$, which changes in accordance with the voltage at the connection node between the constant current circuit 3 and the LED 10. Therefore, in this drive circuit which drives the LED 10 to emit in accordance with the pulse signal modulated by PWM modulation, a higher voltage at the terminal of the LED 10 due to the inconsistencies arising during the manufacturing process can be avoided. As a result, a lower power consumption can be obtained.

In the previous discussion, one drive circuit which drives one LED 10 is described as an example. However, the concept of this disclosure is equally applicable to other drive circuits which drive a plurality of LED devices. To drive a plurality of LED devices, the LED devices are connected in parallel with each other.

Further, the concept of this disclosure is equally applicable to other applications in which the drive circuit drives a load other than the LED. For such applications, the LED 10 may be replaced by the load.

Numerous additional modifications and variations are possible in light of the above teachings. It is therefore to be understood that within the scope of the appended claims, the disclosure of this patent specification may be practiced otherwise than as specifically described herein.

What is claimed is:

1. A drive circuit, comprising:

a constant voltage circuit configured to supply a constant voltage to one terminal of a load;

a constant current circuit configured to supply a predetermined constant current to another terminal of the load in accordance with a pulse signal input externally; and a first reference voltage generator configured to generate and output a first reference voltage in accordance with an output voltage at an output terminal of the constant current circuit, wherein the constant voltage circuit makes the first reference voltage proportional to the output voltage output to the load, and wherein the first reference voltage generator increases the first reference voltage when the output voltage at an output terminal of the constant current circuit is equal to or below a second reference voltage, decreases the first reference voltage when the output voltage at the output terminal of the constant current circuit is equal to or larger than a third reference voltage larger than the second reference voltage, and keeps the first reference voltage constant when the output voltage at the output terminal of the constant current circuit is between the second reference voltage and the third reference voltage.

2. The drive circuit of claim 1, wherein the first reference voltage generator comprises:

a comparator configured to compare the output voltage at the output terminal of the constant current circuit with the second reference voltage and the third reference voltage, and generate and output a signal indicating a result of a comparison of the voltages;

a counter configured to perform a count-up operation, a count-down operation, or a holding operation with a count number in accordance with the comparison result obtained at the comparator; and a D/A converter configured to generate and output the first reference voltage by performing a digital-to-analog conversion with the signal indicating the count number of the counter.

3. The drive circuit of claim 2, wherein the D/A converter performs a sampling operation with the count number of the counter in synchronization with a predetermined clock signal.

4. The drive circuit of claim 2, wherein the first reference voltage generator includes:

a second reference voltage generator configured to generate and output a second reference voltage by dividing a power supply voltage; and a third reference voltage generator configured to generate and output a third reference voltage by dividing the power supply voltage.

5. The drive circuit of claim 1, wherein the constant voltage circuit, the constant current circuit and the first reference voltage generator are integrated on one IC.

6. An electrical apparatus that drives multiple light emitting devices comprising a drive circuit, the drive circuit, comprising:

a constant voltage circuit configured to supply a constant voltage to one terminal of a load;

a constant current circuit configured to supply a predetermined constant current to another terminal of the load in accordance with a pulse signal input externally; and a first reference voltage generator configured to generate and output a first reference voltage in accordance with an output voltage at an output terminal of the constant current circuit, wherein the constant voltage circuit makes the first reference voltage is proportional to the output voltage output to the load, and wherein the first reference voltage generator increases the first reference voltage when an output voltage at an output terminal of the constant current circuit is equal to or below a second reference voltage, decreases the first reference voltage when the output voltage at the output terminal of the constant current circuit is equal to or larger than a third reference voltage larger than the second reference voltage, and keeps the first reference voltage constant when the output voltage at the output terminal of the constant current circuit is between the second reference voltage and the third reference voltage.

7. The electrical apparatus of claim 6, wherein the first reference voltage generator comprises:

a comparator configured to compare the output voltage at the output terminal of the constant current circuit with the second reference voltage and the third reference voltage, and generate and output a signal indicating a result of a comparison of the voltages;

a counter configured to perform a count-up operation, a count-down operation, or a holding operation with a count number in accordance with the comparison result obtained at the comparator; and a D/A converter configured to generate and output the first reference voltage by performing a digital-to-analog conversion with the signal indicating the count number of the counter.

8. The electrical apparatus of claim 7, wherein the D/A converter performs a sampling operation with the count number of the counter in synchronization with a predetermined clock signal.

9. The electrical apparatus of claim 6, wherein the first reference voltage generator includes:

a second reference voltage generator configured to generate and output a second reference voltage by dividing a power supply voltage; and a third reference voltage generator configured to generate and output a third reference voltage by dividing the power supply voltage.

10. The electrical apparatus of claim 6, wherein the electrical apparatus is a mobile phone.

11. An electrical apparatus that drives a load, the electrical apparatus comprising a drive circuit, the drive circuit, comprising:

a constant voltage circuit configured to supply a constant voltage to one terminal of a load;

a constant current circuit configured to supply a predetermined constant current to another terminal of the load in accordance with a pulse signal input externally; and a first reference voltage generator configured to generate and output a first reference voltage in accordance with an output voltage at an output terminal of the constant current circuit, wherein the constant voltage circuit makes the first reference voltage is proportional to the output voltage output to the load, and wherein the first reference voltage generator increases the first reference voltage when an output voltage at an output terminal of the constant current circuit is equal to or below a second reference voltage, decreases the first reference voltage when the output voltage at the output terminal of the constant current circuit is equal to or larger than a third reference voltage larger than the second reference voltage, and keeps the first reference voltage constant when the output voltage at the output terminal of the constant current circuit is between the second reference voltage and the third reference voltage.

12. The electrical apparatus of claim 11, wherein the first reference voltage generator comprises:

a comparator configured to compare the output voltage at the output terminal of the constant current circuit with the second reference voltage and the third reference voltage, and generate and output a signal indicating a result of a comparison of the voltages;

a counter configured to perform a count-up operation, a count-down operation, or a holding operation with a count number in accordance with the comparison result obtained at the comparator; and a D/A converter configured to generate and output the first reference voltage by performing a digital-to-analog conversion with the signal indicating the count number of the counter.

13. The electrical apparatus of claim 12, wherein the D/A converter performs a sampling operation with the count number of the counter in synchronization with a predetermined clock signal.

14. The electrical apparatus of claim 11, wherein the first reference voltage generator includes:

a second reference voltage generator configured to generate and output a second reference voltage by dividing a power supply voltage; and a third reference voltage generator configured to generate and output a third reference voltage by dividing the power supply voltage.

15. The electrical apparatus of claim 11, wherein the electrical apparatus is a mobile phone.

16. The electrical apparatus of claim 11, wherein the constant voltage circuit, the constant current circuit and the first reference voltage generator are integrated on one IC.

* * * * *